US005852423A

United States Patent [19]

Hughes

[11] Patent Number: 5,852,423

[45] Date of Patent: Dec. 22, 1998

[54] VARIABLE POINTING ANTENNA MOUNT, SUITABLE FOR SATELLITE TELECOMMUNICATION ANTENNAS

[75] Inventor: Clifford D Hughes, Noordwijkerhout, Netherlands

[73] Assignee: Agence Spatiale Europeene, Paris, France

[21] Appl. No.: 406,848

[22] PCT Filed: Sep. 24, 1993

[86] PCT No.: PCT/FR93/00937

§ 371 Date: Mar. 7, 1996

§ 102(e) Date: Mar. 7, 1996

[87] PCT Pub. No.: WO94/08360

PCT Pub. Date: Apr. 14, 1994

[30] Foreign Application Priority Data

Sep. 25, 1992 [FR] France ..... 92 11445

[51] Int. Cl.[6] ..... H01Q 1/12; H01Q 3/08

[52] U.S. Cl. ..... 343/765; 343/882

[58] Field of Search ..... 343/765, 766, 343/880, 882; H01Q 3/00, 3/08, 1/12

[56] References Cited

U.S. PATENT DOCUMENTS 3,707,721 12/1972 McCartney ..... 343/766

FOREIGN PATENT DOCUMENTS 0227930 7/1987 European Pat. Off. .
1602194 11/1981 United Kingdom ..... 343/882
2173643 10/1986 United Kingdom ..... 343/766

*Primary Examiner*—Michael C. Wimer
*Attorney, Agent, or Firm*—Sughrue, Mion, Zinn, Macpeak & Seas, PLLC

[57] ABSTRACT

The disclosed mount comprises a first dihedral (ABC, BCD) of which one of the planes (ABC) is borne on a support base; means (6) for adjusting the angle (α) of said first dihedral; a second dihedral (BCD, BDE) of which one of the planes (BCD) is common to the first dihedral and the other plane (BDE) carries means (8) for supporting the antenna, the axis (BC) of the first dihedral and the axis (BD) of the second dihedral being neither parallel nor merged; and means (7) for adjusting the angle (β) of said second dihedral.

7 Claims, 5 Drawing Sheets

VARIABLE POINTING ANTENNA MOUNT, SUITABLE FOR SATELLITE TELECOMMUNICATION ANTENNAS

BACKGROUND OF THE INVENTION

1. Field of Invention

The invention concerns an antenna mount suitable for a satellite telecommunication antenna.

2. Prior Art

Terrestrial satellite communication antennas and, more generally, microwave antennas have to be pointed very accurately in a given direction, which may be fixed or mobile. This direction is that of a communication satellite, for example, usually a satellite in a quasi-geostationary or quasi-geosynchronous orbit (although this situation and that of a satellite communications antenna are in no way limiting on the invention).

There are various types of antenna mount, i.e. the mechanism which supports the antenna and points it accurately.

The type of mount most frequently used for terrestrial satellite communication stations is the so-called "elevation-azimuth" type of mount, which has a rigid basic structure on which is mounted a structure which rotates about a vertical axis and which carries a structure turning about a horizontal axis and to which the antenna is fastened.

Most mounts are heavy and complex. Accordingly, they are not suited to mass production or to mobile, portable or demountable terrestrial stations where light weight and ease of erection are essential.

On the other hand, lightweight mounts are difficult to adjust accurately, whether by hand or by means of a motor drive system. Also, it is usually necessary to provide a rigid support such as a support plate or slab.

Another problem with many existing antennas is that they were initially designed to point at quasi-geostationary satellites, i.e. for fixed pointing. Because the motors for correcting the position of the satellite eventually run out of fuel, most satellites which used to be geostationary now have a progressively increasing orbital inclination (in which case the geostationary orbit degrades into a geosynchronous orbit). This means that the Earth stations must be capable of mobile pointing, at least in a limited range of movement, to be able to track the satellite at all times.

European patent application EP-A-0 227 930 (SIEMENS) discloses a varible pointing antenna mount, in particular in FIG. 4 of that document. The mount is made up of two dihedra with variable angles. However these two dihedra do not have any common plane.

SUMMARY OF INVENTION

Antenna mounts proposed until now cannot reconcile these various requirements in a satisfactory way.

An object of the invention is to propose an antenna mount which is adjustable to enable accurate pointing and tracking of a satellite, which is advantageously foldable for easy transport and quick demounting/erection, and which has a mechanically simple, rugged and low-cost structure.

To this end, the mount of the invention is characterized in that it includes: a first dihedron one plane of which is carried by a support base; means for varying the angle of said first dihedron; a second dihedron one plane of which is common to the first dihedron and the other plane of which carries means for supporting the antenna, the axis of the first dihedron and the axis of the second dihedron being neither parallel nor coincident; and means for varying the angle of said second dihedron.

To be more precise, a mount of this kind can include: a first structure defining a first triangle fastened to said support base; a second structure defining a second triangle, the first and second triangles having a common side having a first hinged connection to constitute the first dihedron, the means for varying the angle of the first dihedron being disposed between the corner of the first triangle opposite the hinged side and the corner of the second triangle opposite this same side; and a third structure defining a third triangle, the second and third triangles having a common side having a second hinged connection to constitute the second dihedron, the means for varying the angle of the second dihedron being disposed between the corner of the second triangle opposite the hinged side and the corner of the third triangle opposite this same side.

The means for adjusting the first and second dihedra are preferably separable from said structures to enable the mount to be folded flat by closing the two dihedra.

The means for varying the angles of the first and second dihedra are preferably controlled by calculating means adapted to convert set point values expressed as elevation angles and azimuth angles into signals directly controlling the position of said adjustment means.

Other features and advantages of the invention will emerge from a reading of the following detailed description given with reference to the appended drawings.

DESCRIPTION OF THE PREFERRED EMBODIMENTS

Figure 1:
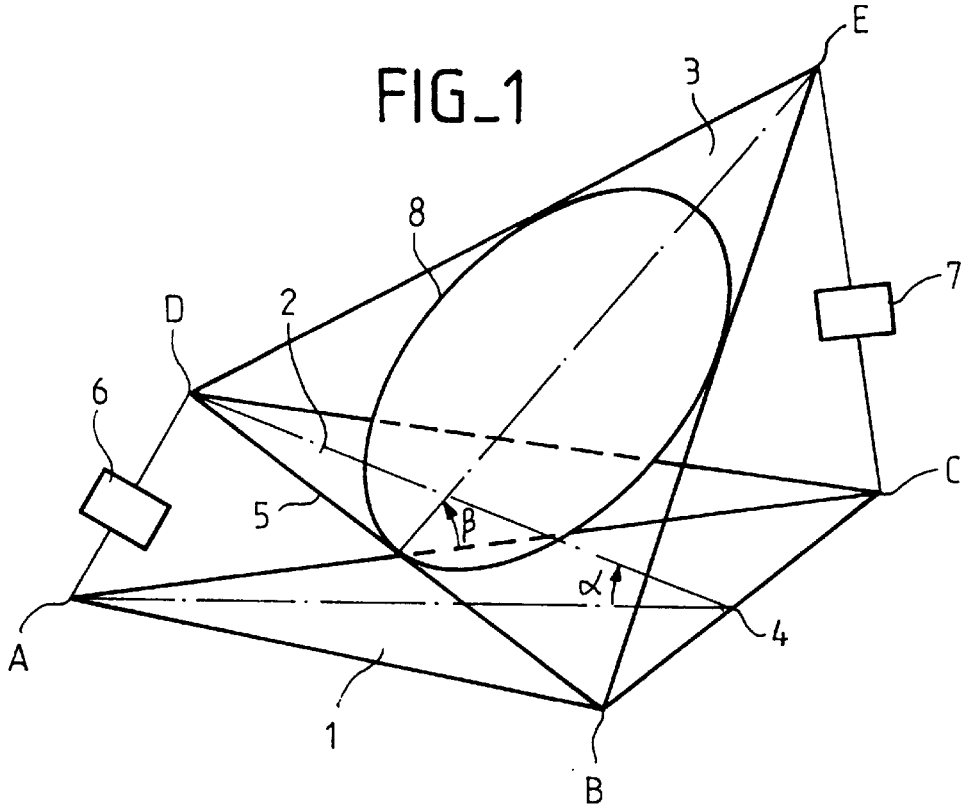
FIG. 1 is a diagrammatic view showing the structure of the mount of the invention.

FIG. 1 shows the general structure of the mount of the invention which includes a first triangular structure 1 (triangle ABC) to which is hinged a second triangular structure 2 (triangle BCD) to which is hinged a third triangular structure 3 (triangle BDE). The structures 1 and 2 are hinged at line 4 along the side BC and the structures 2 and 3 are hinged at line 5 along the side BD, i.e. along a side other than the side at which the structures 1 and 2 are hinged.

For simplicity, the triangles ABC, BDC and BDE are preferably all equilateral triangles, but this is by no means essential.

The structures 1 and 2 accordingly define a first dihedron ABC, BCD with a variable angle $\alpha$ between them which can be adjusted by an actuator 6. This is a manual or motorized actuator, for example a linear electric actuator between the corners A and D.

In a like manner the structures 2 and 3 define a second dihedron BCD, BDE with a variable angle $\beta$ between them which can be adjusted by a second linear actuator 7 between the corners E and C. AD and EC therefore form variable length struts.

To enable adjustment in all directions it is essential that the edge of the first dihedron (BC) and that of the second dihedron (BD) are neither parallel nor coincident since if they were one of the two degrees of freedom of the mount would be lost; it is not necessary for them to be concurrent, however.

The first structure 1 is fixed and the third structure 3 carries antenna support means, for example a ring 8 in the form of a circle inscribed inside the triangle BDE and which is to support the paraboloid of the antenna (which can be larger or smaller than the support ring 8). If the antenna is a paraboloid or part of a paraboloid it is relatively simple to fix it to a triangular structure such as the structure 3 and it is for this reason that triangular structures are preferred for defining the dihedra (another reason being the possibility of folding triangles one against another as will be explained in more detail with reference to FIG. 4). The choice of a triangular structure to define each of the half-planes of each of the dihedra is not indispensible, however, as the triangles ABC, BCD and BDE can be virtual triangles defined on structures whose physical contour is not necessarily triangular.

From the above description, it is clear that varying the lengths of the segments AD and CE by means of the actuators 6 and 7 modifies the values of $\alpha$ and $\beta$ which modifies the direction in which the antenna points, so that the latter can be pointed within a very wide range of elevation and azimuth angles, greatly exceeding the requirement for merely tracking satellites in quasi-geosynchronous orbit.

As the directions of the segments AD and EC are not orthogonal, to obtain given elevation and azimuth angles the adjustment of the actuator 6 and 7 must be calculated beforehand, as described below.

If A is the azimuth angle, S the elevation angle, $\alpha$ the angle of the dihedron ABC, BCD and $\beta$ the angle of the dihedron BCD, BDE, it is necessary to solve the equations $A=f(\alpha,\beta)$ and $S=f(\alpha,\beta)$, which can be done by a microprocessor-based computer using a relatively simple pointing and tracking program.

Considering the various mobile Cartesian systems of axes, it can be shown that, X, Y and Z being the components of the vector normal to the triangle BDE (i.e. the vector defining the pointing direction), in the case of equilateral triangles:

$X=-\cos\beta\sin\alpha+\sin\beta\sin 30°\cos\alpha$, $Y=-\sin\beta\cos 30°$, and $Z=\cos\beta\cos\alpha+\sin\beta\sin 30°\sin\alpha$.

The azimuth angle A and the elevation angle S can be deduced from these values X, Y and Z by the following equations:

$A=\arctan(X/Y)$, and $S=\arctan[Z/(X^2+y^2)^{1/2}]$.

Thus this determination entails only simple calculations which are easy to implement on a microprocessor incorporated in the mount control system or a microcomputer handling this task, among others. This increases only very slightly the overall cost of the system comprising the mount and its control system.

With regard to the configuration of use, the first structure 1 can be simply laid on the ground, as shown diagrammatically in FIG. 1.

Figure 2:
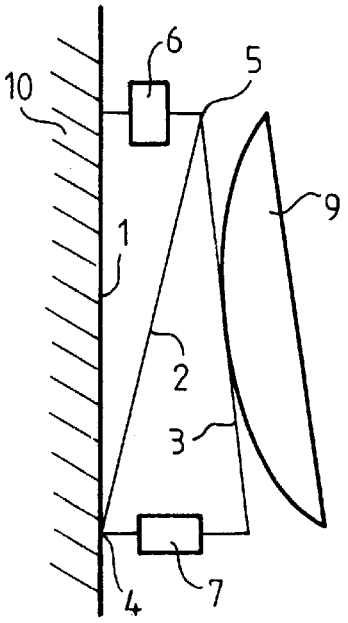
FIG. 2 shows how the mount of the invention can be used for a wall-mounted antenna.

As shown in FIG. 2, the first structure can instead be fixed to a wall 10, a relatively frequent configuration for satellite antennas and which provides a continuously adjustable mount supporting the antenna, which in this instance is a simple paraboloid 9.

Figure 3:
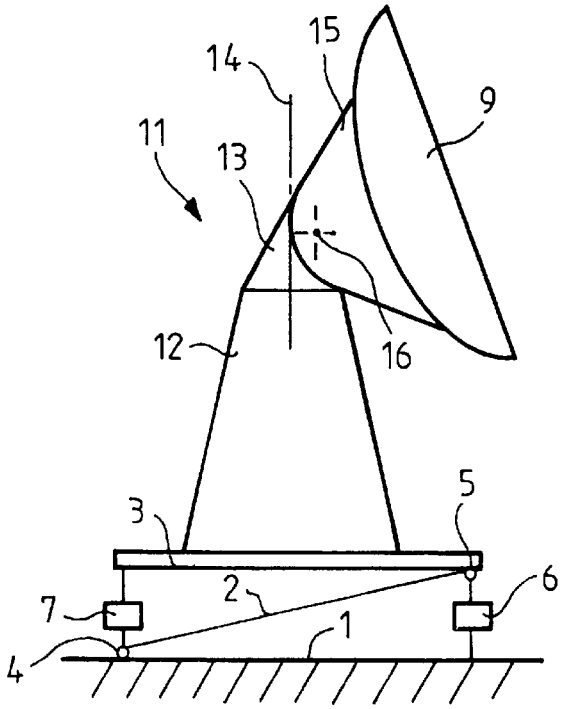
FIG. 3 shows how the structure of the invention can be used for a fixed installation of the antenna on the ground, suitable for a conventional "elevation-azimuth" antenna.

In the FIG. 3 example the mount of the invention has the first structure 1 resting on the ground but the third structure 3 does not carry the antenna directly, as in FIGS. 1 and 2, but instead carries an existing elevation-azimuth type antenna mount 11 comprising a vertical mast 12 carrying an assembly 13 rotating about a vertical axis 14 and to which the antenna support 15 is articulated about a horizontal axis 16. This configuration enables continued use of a fixed pointing antenna mount even if, in the course of time, satellites nearing the end of their service life are subject to substantial variations in their pointing direction, which variations can typically be as much as 5°. A motorized continuous tracking system is needed to compensate such variations.

Figure 4:
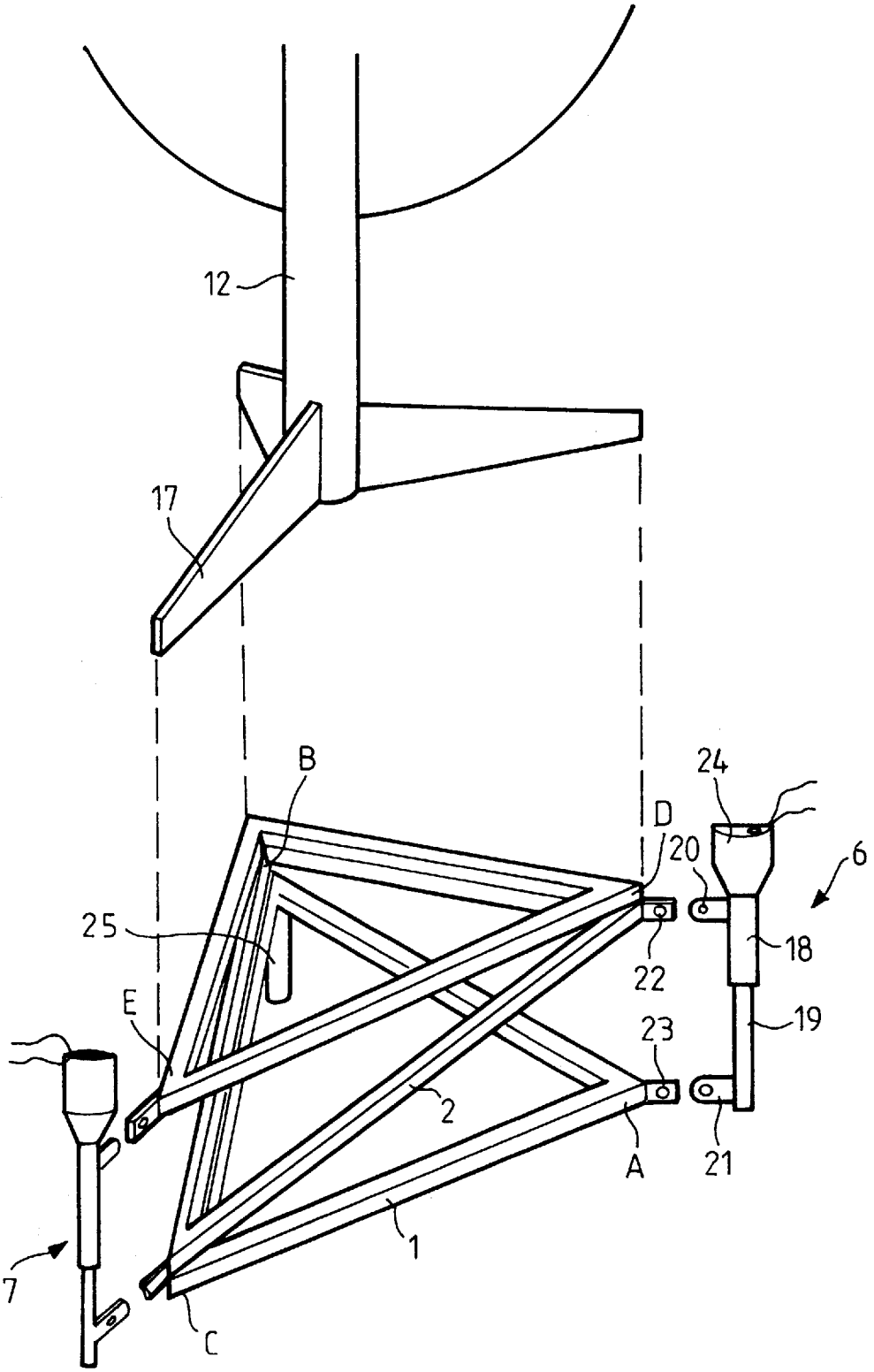
FIG. 4 shows an embodiment of the invention suitable for a fixed pointing antenna where slight variations in the pointing direction are allowed in order to be able to track the satellite at all times.

FIG. 4 shows one mechanically very simple form of construction suitable for this situation. The existing antenna is mounted on a mast 12 with a tripod support 17. The additional mount, incorporating the teaching of the invention, is constructed from square cross-section steel or aluminium tube, which can be "off the shelf" sections assembled by conventional methods (all-welded or part-welded). The articulations can be very simple, for example hinges for doors or windows.

From the point of view of static loads, it will be noted that the triangular construction of the mount of the invention transfers all loads to the intersections, which makes it very rugged and enables the use of relatively lightweight materials to construct it. With regard to the hinges, they are essentially exposed only to gravity loads and wind loads, so that the pointing tolerances compare favorably with those of conventional solutions.

The actuators 6 and 7 can each comprise an electric linear actuator with a body 18 and a mobile rod 19 with respective attachments 20 and 21 fixed to homologous attachments 22 and 23 on the triangular structures. The respective motor 24 of each actuator is electrically connected to a control system, the two actuators being physically and electrically independent. To enable initial coarse pointing or to compensate for any tilt it may be beneficial to provide a fixed or adjustable extra support strut 25 under one corner A, B or C of the first structure.

Figure 5:
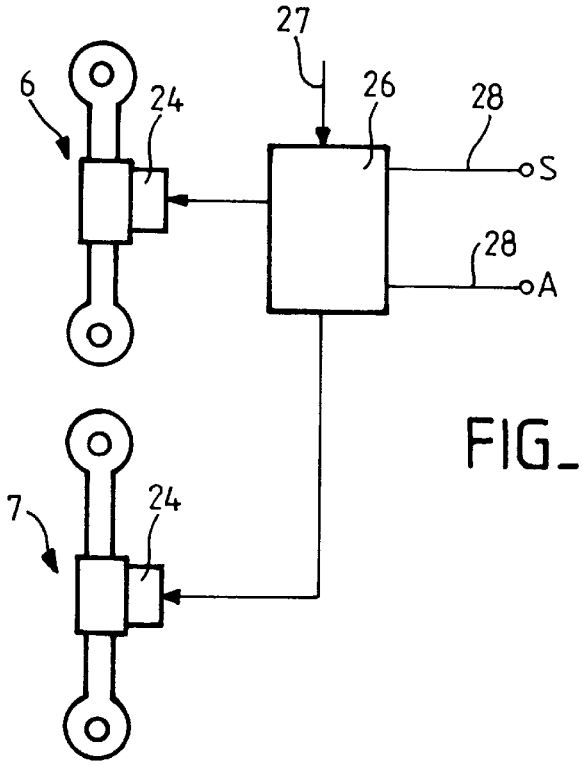
FIG. 5 is a schematic showing the calculation and actuator position control device.

FIG. 5 is a schematic showing the control circuit which includes an electronic and electrical unit 26 for calculating coordinates and controlling the respective motors 24 of the actuators 6 and 7; the unit 26 is connected to a power supply line 27 and to lines 28 over which it receives conventional elevation S and azimuth A set point signals. These digital or analog signals are processed in the unit 26 by a method of coordinate transformation in order to determine the length of the struts controlled by the actuators 6 and 7 to obtain the required elevation and azimuth angles.

Figure 6:
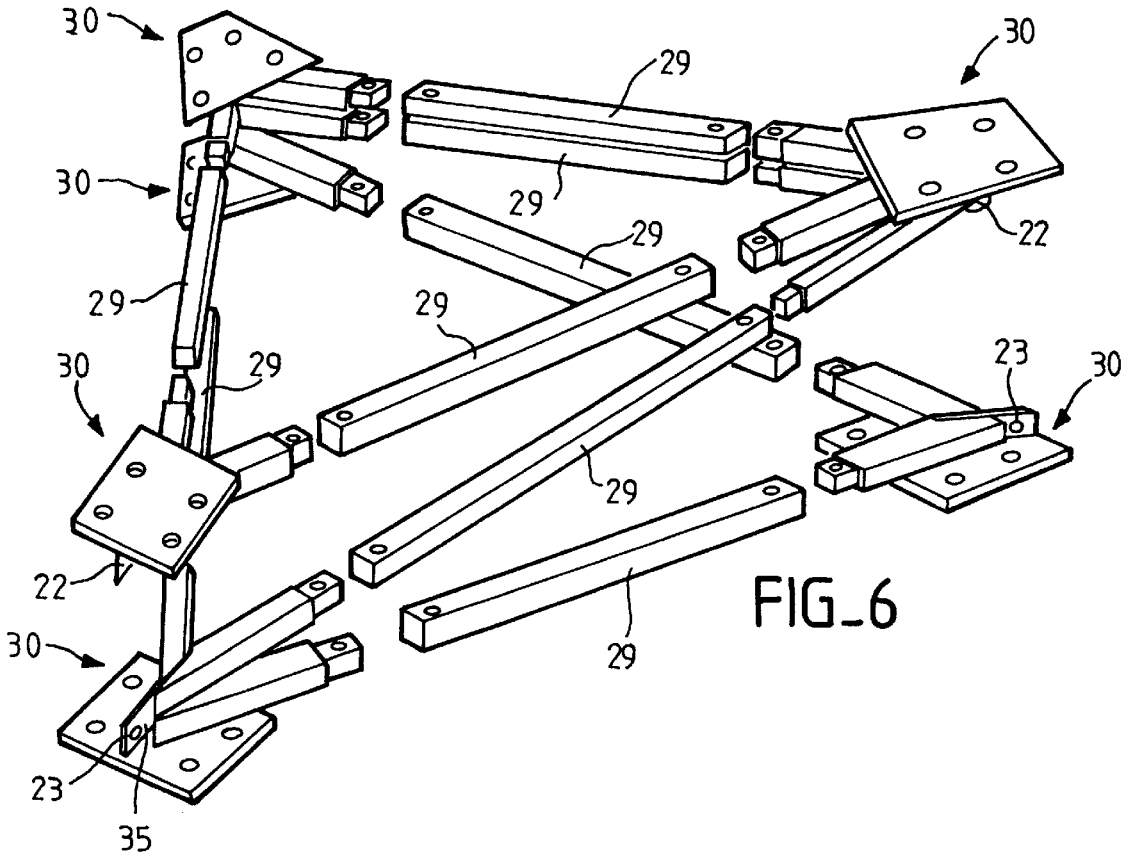
FIG. 6 is a perspective view showing how the mount of the invention can be mechanically constructed in a foldable and demountable form.

FIG. 6 shows an implementation that is particularly suitable for a demountable and portable mount. The mount is constructed essentially from square sections 29 constituting the three sides of each of the three triangles (so that nine such sections are required in all). They are interconnected by five connecting members 30.

The connecting members 30 which define the corners of the triangles ABC, BCD and BDE are not identical because of the specific geometry of each corner. They are all made from the same main components, however, shown by way of example in FIGS. 7 through 9 for the connecting member 30 which is that at the rear in the perspective view (and therefore corresponds to corner B), which is the most complex of them: the connecting members include at least one fixing plate 31 (two such plates in the case of the member shown in FIGS. 7 through 9) with holes 32 for fixing it to the ground or to an antenna support, as appropriate (bottom plates or top plates). Segments 33 defining the various triangle corner angles end at 34 in male parts which fit inside the sections constituting the sides of the triangles, being attached to the latter by means of a system of screws or pins, for example.

Figure 8:
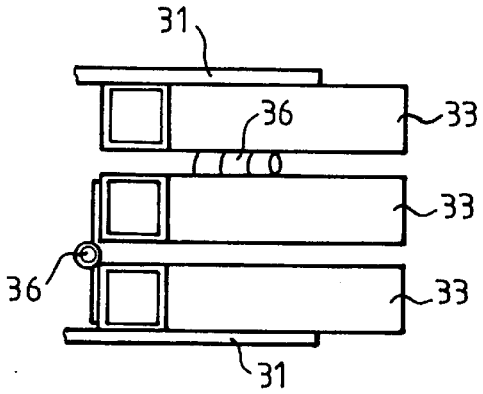
FIGS. 8 and 9 are side views of the member from FIG. 7.
Figure 9:
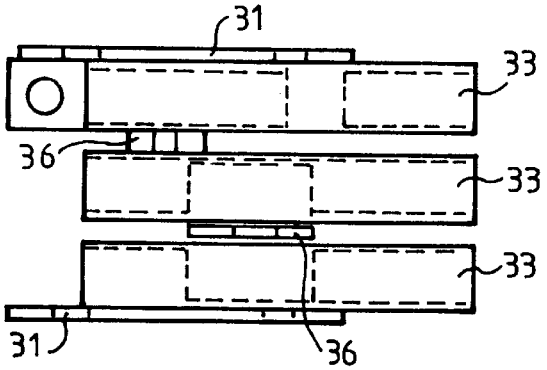
Figure 7:
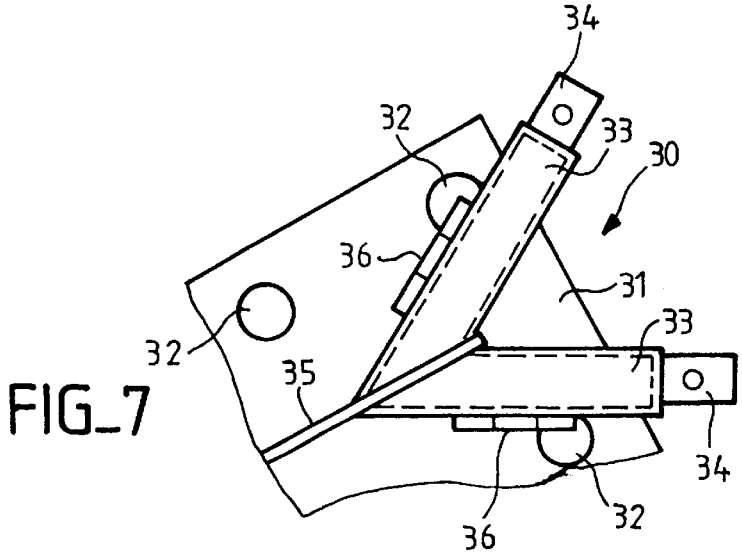
FIG. 7 shows one of the connecting members of the mount from FIG. 6.

The four connecting members 30 other than that shown in FIGS. 7 through 9 also carry a vertical support 35 enabling the actuators to be fastened into holes 22 and 23 provided in the members 35, preferably by easily demountable means (nesting or screwed) so that the actuators can be demounted quickly and the structure folded flat, which is highly beneficial in the case of portable stations where transportability and quick erection are essential.

The connecting members 30 also carry the hinges 36 which hinge together the three triangles of the mount; the hinges and their disposition are seen particularly clearly in FIGS. 8 and 9.

Figure 10:
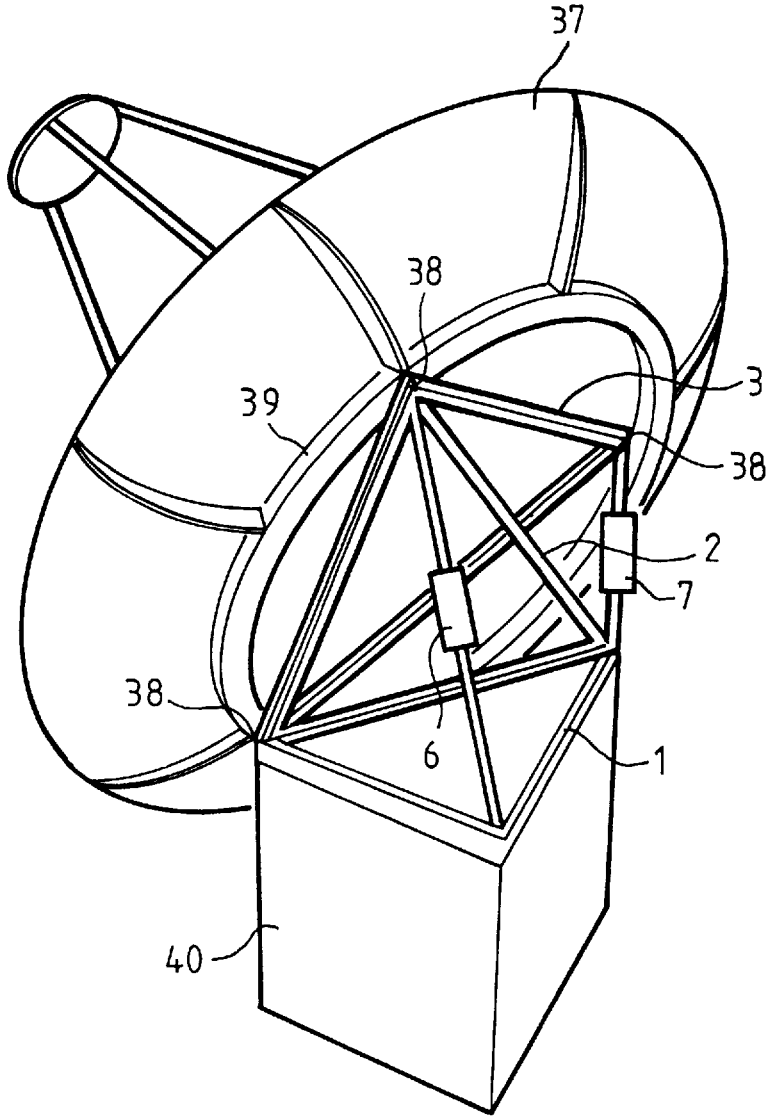
FIG. 10 shows how the mount of the invention can be used as a main mount of a large antenna.

FIG. 10 shows an embodiment suitable for an entirely different situation in which the mount of the invention provides a fixed primary mount for a large diameter antenna and simply replaces the conventional elevation-azimuth mount. To this end the antenna support triangle 3 is joined to the antenna 37 at three equidistant points 38 fastened to the annular member 39 of the antenna support frame on the back of the reflector. The bottom triangle 1 is placed on a fixed base 40, for example a concrete plinth, or on the roof of a building. The actuators 6 and 7 have the same functions as in the embodiments previously described, but with very much larger angles $\alpha$ and $\beta$ in this case, since the aim is no longer to compensate a slight pointing error but to carry out pointing proper.

I claim:

1. A variable pointing antenna mount suitable for an antenna pointing at a satellite comprising:

a first dihedron (ABC, BCD), one plane (ABC) of which is carried out by a support base (10), another plane (BCD) being hinged along a first axis (BC), means (6) for varying the angle ($\alpha$) of said first dihedron, a second dihedron (BCD, BDE), one plane (BCD) of which is common to the first dihedron and another plane (BDE) carrying means (8) for supporting an antenna (9), said first axis (BC) of the first dihedron and a second axis (BD) of the second dihedron being neither parallel nor coincident with each other, means (7) for varying the angle ($\beta$) of said second dihedron, a first structure defining a first triangle (ABC) fastened to said support base, a second structure defining a second triangle (BC), the first and second triangles having a common side (BC) having a first hinged connection (4) to constitute the first dihedron said means (6) for varying the angle of the first dihedron being disposed between a corner (A) of the first triangle opposite the hinged side and a corner (D) of the second triangle opposite said hinged side, and a third structure (3) defining a third triangle (BDE), the second and third triangles having a common side (BD) having a second hinged connection (5) to constitute the second dihedron, said means (7) for varying the angle of the second dihedron, said means (7) for varying the angle of the second dihedron being disposed between said corner (D) of the second triangle opposite said hinged side and a corner (E) of the third triangle opposite said hinged side.

2. The mount of claim 1 wherein the means for varying the angle of the first and second dihedra are separable from said structures to enable the mount to be folded flat by closing the first and second dihedra.

3. The mount of claim 1 wherein the means (6, 7) for varying the angles of the first and second dihedra are controlled by calculating means (26) adapted to convert set point values expressed as elevation angles (S) and azimuth angles (A)into signals directly controlling the position of said means for varying said angles.

4. The mount of claim 1 wherein said means for varying said angle ($\alpha$) of said first dihedron and said means for varying said angle ($\beta$) of said second dihedron each comprise a linear actuator.

5. The mount of claim 1 wherein said means for supporting an antenna comprises a circular ring inscribed on said third triangle (BDE) of said second dihedron.

6. The mount of claim 1 wherein said means for supporting an antenna comprises a mast carrying an assembly rotating about a vertical axis, and an antenna support mounted to said mast for movement about a horizontal axis.

7. The mount of claim 1 wherein said means for supporting an antenna comprises a support triangle attached to an antenna at three equidistant points.

* * * * *